United States Patent [19]

Marquez Serra

[11] 3,946,536

[45] Mar. 30, 1976

[54] MACHINE FOR PLACING INJECTABLE AMPOULES, VIALS AND SIMILAR LIQUID CONTAINERS IN THEIR RESPECTIVE HOLDERS

[76] Inventor: Don Luis Antonio Marquez Serra, 126 Calle Bailen, Barcelona, Spain

[22] Filed: Jan. 22, 1975

[21] Appl. No.: 543,137

[30] Foreign Application Priority Data

Jan. 23, 1974 Spain ..... 422692

[52] U.S. Cl. ..... 53/148; 53/183; 53/196; 53/236; 53/251

[51] Int. Cl.[2] ..... B65B 35/44; B65B 43/00

[58] Field of Search ..... 53/142, 148, 166, 183, 53/196, 236, 246, 251, 252

[56] References Cited

UNITED STATES PATENTS

| | | | |
|---|---|---|---|
| 2,756,553 | 7/1956 | Ferguson et al. | 53/251 X |
| 2,881,682 | 4/1959 | Engleson et al. | 53/252 X |
| 3,241,289 | 3/1966 | Molins | 53/252 X |

*Primary Examiner*—Robert L. Spruill
*Attorney, Agent, or Firm*—Gregory J. Nelson

[57] ABSTRACT

The present application discloses a machine for inserting ampoules or similar containers in holders suitable for packing and shipping. A conveyor chain carries a series of trays having receptacles adapted to receive a preselected number of ampoules. A hopper feeds the preselected number of ampoules into the receptacles by gravity. An inclined ramp accommodates a stack of flat holder blanks of cardboard or the like. Each tray is provided with projection means which grasp a single blank from the stack and moves it along in alignment with the tray. A guide system has rails extending longitudinally along the conveyor adapted to engage the blank and erect it to a U-shape. A ramp adjacent the chain has a contoured camming surface which engages the ampoules and moves the ampoules transversely into appropriate apertures in the aligned, erected holders.

4 Claims, 13 Drawing Figures

MACHINE FOR PLACING INJECTABLE AMPOULES, VIALS AND SIMILAR LIQUID CONTAINERS IN THEIR RESPECTIVE HOLDERS

The present invention relates to a machine for automatically placing injectable ampoules, vials and similar liquid containers in holders which protect the liquid containers.

More particularly, the present invention relates to a machine for automatically inserting liquid containers, such as ampoules, in support of the type disclosed in my patent application entitled "Support For Packing Ampoules And Similar Containers" Ser. No. 543,138 filed concurrently herewith and now abandoned.

The present invention concerns itself with an automated conveyor system for inserting liquid containers such as ampoules into suitable holders. The ampoules are automatically grouped according to the number of ampoules to be contained in each holder. The holder, preferably formed from a semi-rigid cardboard is automatically folded and erected. The pre-selected groups of ampoules are aligned with the erected holder and appropriately inserted into apertures or holes provided in the holder for this purpose.

The system of the present invention is simple, reliable and economical to construct and operate. The system integrates all necessary sorting, loading, erecting and inserting operations in a substantial degree of efficiency and productivity not available with prior art systems which depended on a substantial number of manual operations.

Briefly, the system of the present invention comprises a machine having an endless conveyor chain or belt which moves at a uniform rate of speed by means of a suitable motorized system. The conveyor chain carries a series of trays, each of which define a fixed number of transverse cradles or receptacles which are adapted to receive the ampoules or liquid containers to be packed. The chain runs beneath a loading hopper which contains the supply of ampoules properly aligned with the receptacles. The ampoules are discharged by gravity and are fed into the receptacles and are carried along to a mechanism which effects their insertion into the respective holder. In one embodiment of the invention, the hopper is shaped so as to be fed with trays or pans, which are filled with a large quantity of properly aligned ampoules enabling the hopper to be continuously supplied. Each of the trays or slats on the conveyor chain have a projection which grasps a holder blank from a supply stack adjacent the chain. The supply stack is pressure fed by a gravity system or by an appropriate spring system. A system of guides serve to fold said blank holder sheets in correct form for final boxing.

The ampoules are moved transversely in respect to the machine's axis by a ramp or camming surface into appropriate apertures in the erected holder.

The above and other objects and advantages of the present invention will be had from consideration of the specification and drawings in which.

Figure 6:
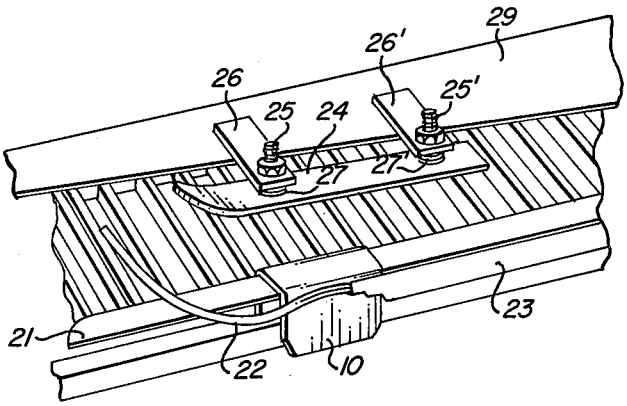
Figure 5A:
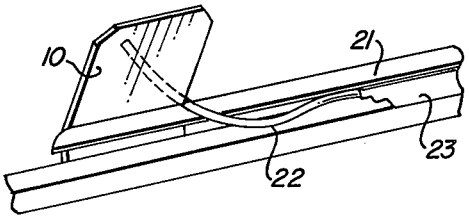
Figure 5B:
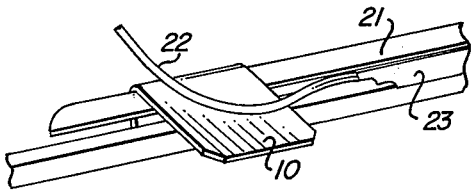
Figure 5C:
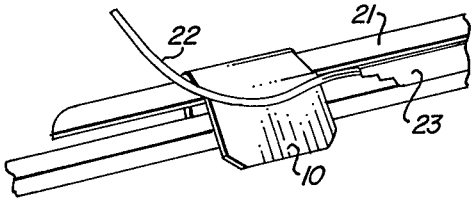
Figure 5D:
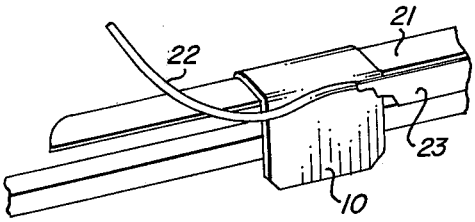
Figure 7:
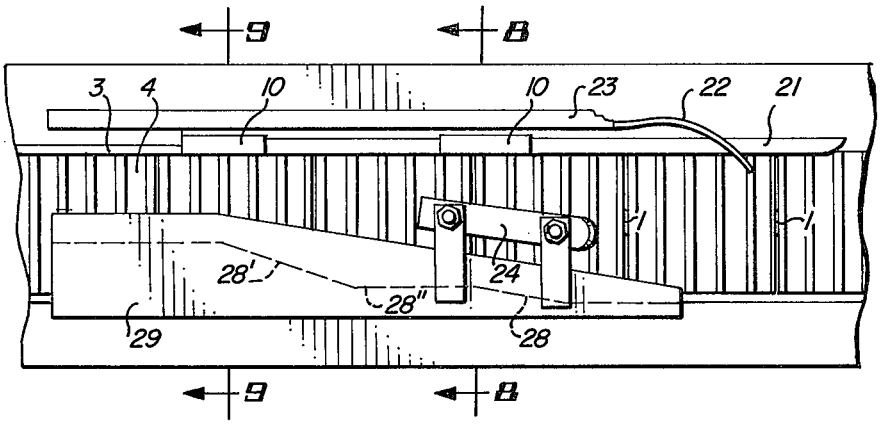
Figure 8:
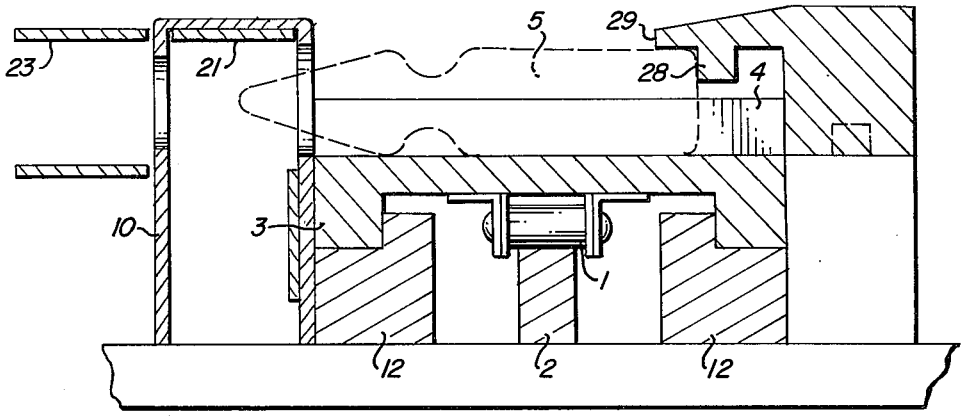
Figure 9:
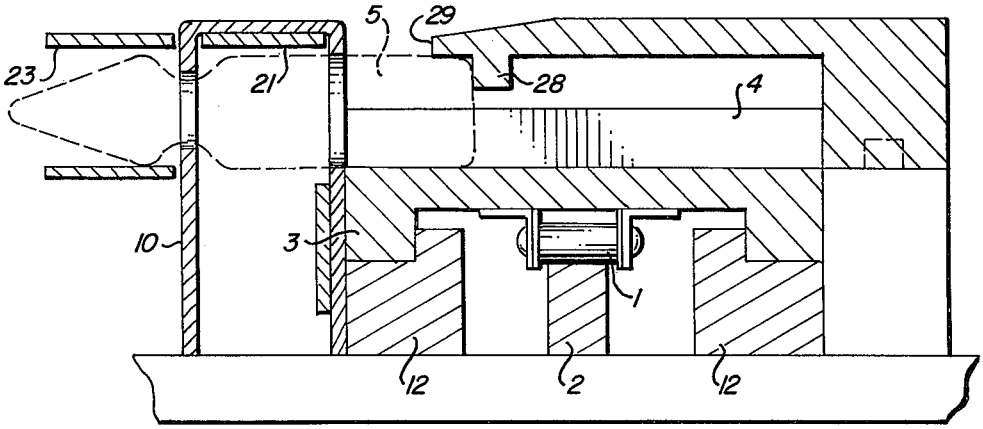

FIGS. 5, 5*a*, 5*b*, 5*c* and 5*d* are detail views in perspective showing the different phases of the folding operation to which the holders are subjected during their movement along the machine through the system of combination guide and folding mechanism;

FIG. 6 is a detail perspective view showing the structure for inserting the ampoules into their respective tray receptacles;

FIG. 7 is a plan view showing the inclined plane system which provides for the transverse movement of the ampoules from the tray receptacles to the holder receptacles; and FIGS. 8 and 9 are cross-sectional views taken along lines 8—8 and 9—9 of FIG. 7.

Broadly, the machine includes a chassis or framework, not shown, which can have any suitable structure. The frame perferably has means for transporting it from one location to another and is designed to be placed directly on a floor or upon any type of adequate support, such as the frame of a second machine with which the machine of the invention could work in combination. The frame can be fabricated from metal plate suitably cut and formed and has a top flat surface appreciably sloped having an ample longitudinal opening upon which is fixed a plate to which the machine can be secured. A removable cover can be placed on this surface and fixed in position through any conventional fastener means. The assembly is completed with a conventional control panel containing the necessary drive elements of the machine, as well as the controls themselves and the safety mechanisms. The control panel will be situated at a location convenient and accessible for the operator.

Referring now to the drawings, the machine includes an endless conveyor chain or belt supported in a horizontal position by appropriate sprockets 2 and intermediate guides. The belt or chain 1 is moved by an appropriate drive system, for example, through means of an electromotor and gear reducer, not shown. A transmission can be included for achieving speed regulation through gear changes. A series of flat rectangular plates 3 are attached to chain 1, each of which defines a group of cradles or receptacles 4 transversely arranged relative to the chain 1. The receptacles 4 are identical and are regularly spaced and each is designed to receive a single container or ampoule. The number of cradles or receptacles provided in each of the plates or trays 3 will coincide with the number of ampoules to be contained in a given holder. This number is variable from one to a dozen or even more. It is, of course, necessary to design the endless chain so that it can be assembled and disassembled with ease, in order to facilitate changing the number of recptacles required for given holders and to be able to use receptacles of different dimensions. In this way, the machine can be adapted for use with various types of holders and various sizes or types of ampoules or similar liquid containers. It may be desirable to subdivide trays 4 into two or more sections which are articulated and connected. This will make it possible to maintain reasonable limits on the radius required at the sprockets 2 of the chain, particularly when the articulated trays are of considerable length where they are, for example, arranged to receive ten, twelve or more ampoules.

Chain 1 is adapted to run beneath a hopper containing a supply of ampoules 5, transversely arranged in the hopper with their axes mutually parallel and transverse to the chain and by gravity and in contact with one another are fed into the receptacles 4. The width of the lower opening or outlet of the hopper is selected to accommodate the sum of the diameters of a given number of ampoules plus a predetermined clearance. In this way, the smooth continual descent of the ampoules into the receptacles 4 is assured avoiding blockage that could result from a malfunctioning of the machine. The supply of ampoules in the hopper can always be maintained above a certain level through any number of conventional manual or automatic systems.

Figure 3:
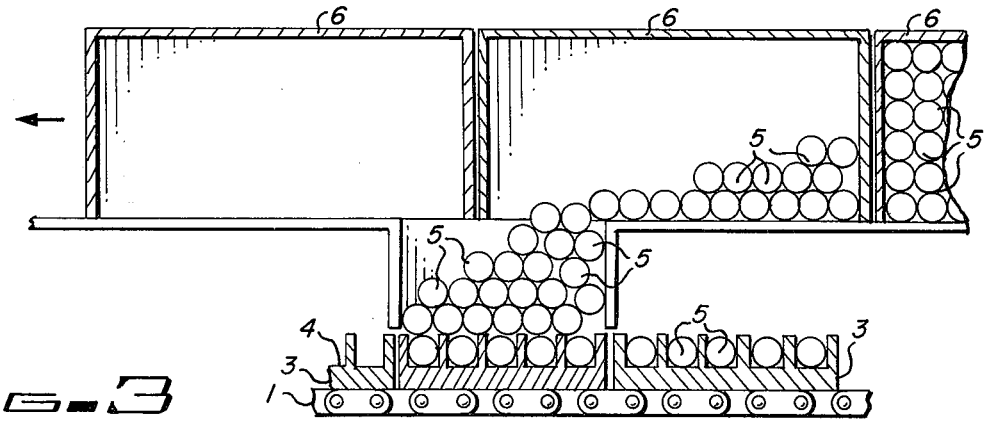
FIG. 3 is a front elevational view showing the operation of the feeding arrangement shown in the preceding figure.

In the embodiment shown herein, the assembly is designed to be supplied by trays 6, as seen in FIG. 3, which are filled with ampoules already properly arranged and placed in position. The trays, of conventional type, have one side wall removed to facilitate emptying. The ampoule supply hopper consists of a vertical back wall 7, arranged at right angles to the receptacle trays 3 and two opposite walls 8 and 8' perpendicular to said back wall 7. Two walls 9 and 9' are perpendicular to the back wall and are disposed above the chain. Ampoule supply trays or containers 6 are placed with their respective open sides adjacent walls 9 and 9'.

When the machine is actuated, the space between vertical walls 8 and 8' should contain a supply of ampoules, which can be manually loaded. A supply of trays 6 will be placed on horizontal walls 9 and 9' with their open sides in juxtaposition with the top opening of the hopper enabling the ampoules to drop into the hopper. When the contents of the first tray 6 are emptied an adjacent tray is moved forward along walls 9 and 9' until the open side is in suitable position aligned with the opening of the hopper. The first tray which has been emptied is now withdrawn and through a repetition of this procedure, a continuous supply of ampoules is maintained.

Figure 1:
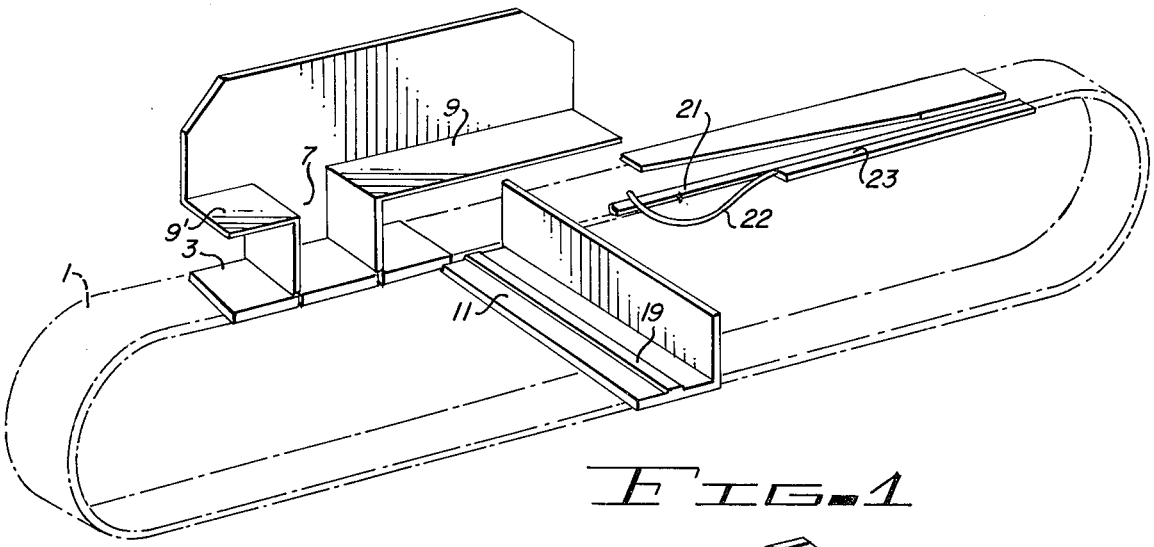
FIG. 1 is a general perspective view of the machine assembly.
Figure 2:
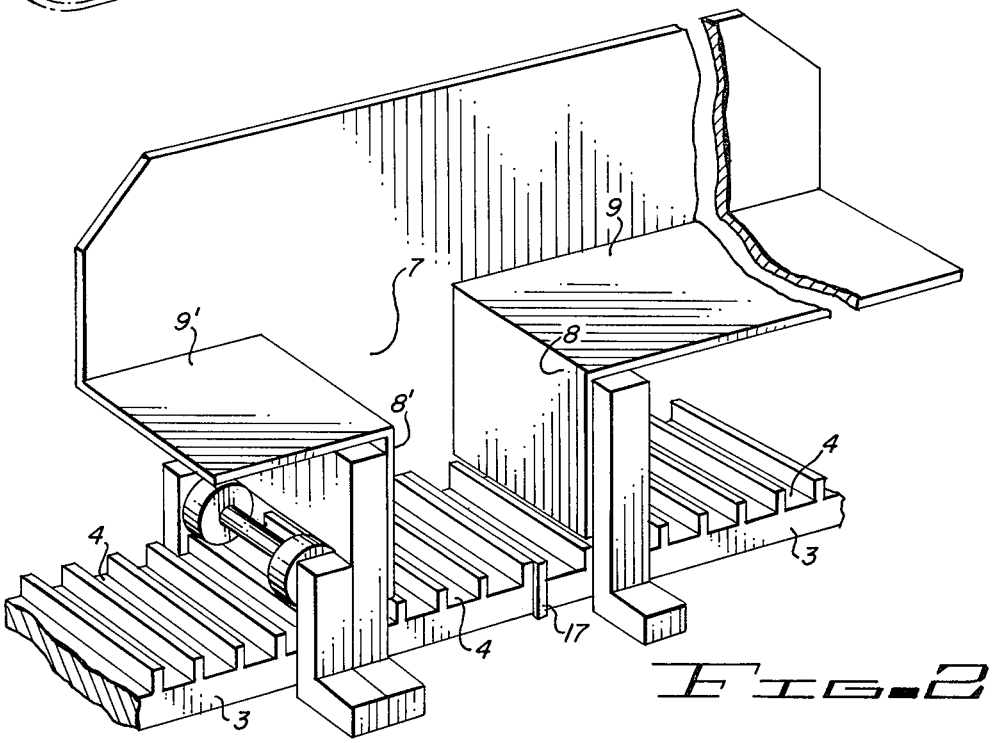
FIG. 2 is a detail perspective view showing the structure of the hopper system which feeds the ampoules, vials or similar liquid containers.
Figure 4:
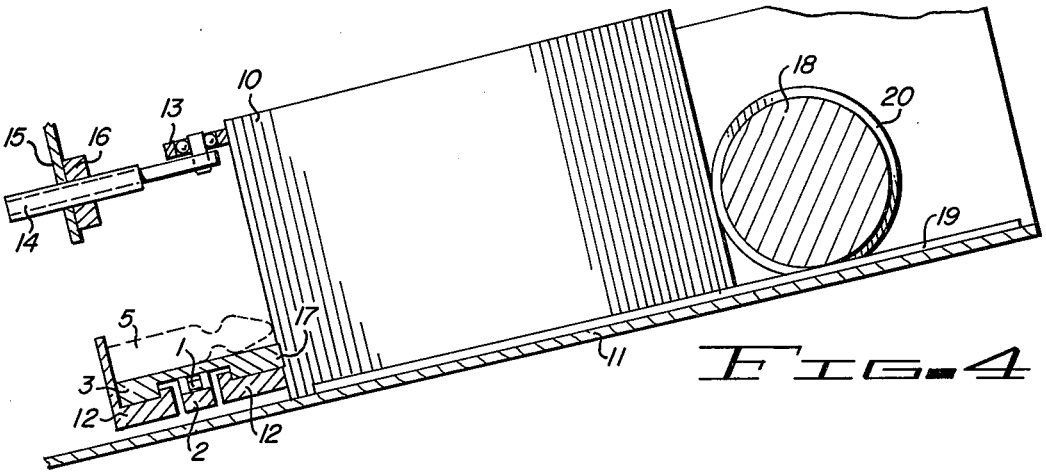
FIG. 4 is a sectional detail view showing the structure of the device through which the machine is fed and the die-stamped flat sheets from which the holders are formed.
Figure 5:
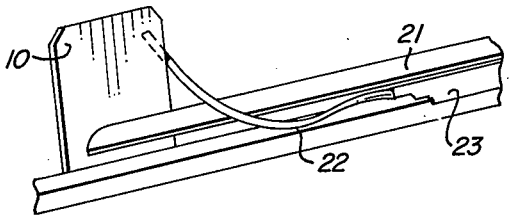

As best shown in FIGS. 1 and 4, the machine uses an arrangement for supplying die-stamped flat sheets 10 of boxboard, light cardboard or equivalent material, from which the holders are formed, through simple folding. As mentioned above, the holders are preferably of the type disclosed in my co-pending patent application entitled "Support For Packing Ampoules And Similar Containers". This supply arrangement consists of an inclined angle iron 11 which is on the same slope as that of the receptacles 4, or on a slightly greater one, and which is positioned with its axis perpendicular to that of the transporting chain. Angle iron 11, which can be U-shaped in cross-section, triangular, or other similar shape, is arranged to accommodate a certain supply of holders 10. The holders 10 are conveniently arranged in a stack. The stack is pushed forward and is forced to slide along a ramp or apron of the machine so that the first of the holders in the stack lies against the top or fixed element of the machine bench with a predetermined pressure holding it in proper position. The fixed elements can consist of the lower guide 12, along which trays 3 slide restrained against lateral movement and by an overhead element, preferably adjustable, such as the head of a threaded sleeve 14 screwed into a fixed support 15. Sleeve 14 can be locked into precise position by means of locknut 16. In the preferred embodiment, the threaded sleeve or bolt 14 contains ball bearing assembly 13 which is in contact with the first holder.

In operation of the machine, it is necessary that each of the trays 3, during the forward movement of the chain, pull along one of the holders separating it from the stack, moving it along the guides which subsequently cause it to be folded as will be explained. In this manner, the movement of the trays and the holders is perfectly synchronized providing for smooth conveying of the ampoules. As seen in FIG. 4, each of the trays 3 is provided with a projecting lateral gripper 17, positioned and dimensioned in such a manner that when it passes by the holder supply device, it grabs the side edge of the first or bottom holder and conveys it along lower guide 12, subjecting it to the guide arrangement causing it to be folded in the manner to be seen hereafter.

It is necessary that each tray or plate 3 grasp one of the holders 10. To achieve this purpose, it is essential that the pressure with which the first or bottom holder in the holder supply device contact fixed elements 12 and 13 and be maintained within predetermined limits. There are many conventional devices or arrangements which can be used to assure the proper magnitude of and constancy of pressure as, for example, a spring system acting upon the top or last holder in the stack maintaining the required tension. Alternately, a worm gear arrangement properly synchronized with the operation of the machine and compensating for the stack of holders, as it decreases in size could be used. The desired pressure can also be maintained simply through means of a roller 18, of predetermined weight, which will roll by gravity along inclined ramp 11. Roller 18 is preferably guided by a central longitudinal rib 10 located in ramp 11 which fits into a corresponding annular groove in roller 18. The use of roller 18 is simple and provides essentially constant pressure which is independent of the quantity of holders stacked on the ramp. Another fundamental advantage is that the supply of holders 10 can be replenished by merely placing a new stack of the same between the last of the present stack and roller 18 without any need for interrupting the operation of the machine.

Each of the holders 10 is engaged first by a respective tray 3 and thereafter by the ampoules contained in said tray. The holder is forced to move along a set of fixed guides, which causes the holder to be folded in a U-shape. These guides consist of a strap or rail 21, parallel to the longitudinal axis of the chain, and a rod 22 bent in the form of an irregular "S" integral with a second strap or rail 23 perpendicular to rail 21 and defining a longitudinal slot therewith. As shown in FIGS. 5*a*, 5*b*, 5*c* and 5*d*, rod 22 engages the flat holder and causes the holder to be folded in a U-shape. The folded or erected holder then passes along rail 21 and comes into position to receive the respective ampoules.

A device is provided at a suitable location along the conveyor chain for insuring correct insertion of the ampoules into the respective cradles or receptacles 4. This device comprises a runner 24, fastened on two threaded vertical rods 25 and 25'. Each rod is supported by a fixed arm 26 and 26', respectively. Spring tension applied through springs 27 and 27' causes runner 24 to engage the ampoules. The tension of the springs can be regulated within limits by adjustment of the nuts on the threaded rods to vary the pressure with which the runner 24 rests upon the ampoules and with which the ampoules lie within their respective receptacles. It may be possible, in some installations, to omit this device, as the ampoules may seat within the receptacles of their own accord.

To insert the ampoules in the holders, as is best seen in FIGS. 7 to 9, a ramp to fixed inclined camming surface 28 is located above trays 3 in a diagonal direction relative to the longitudinal axis of the carrying belt. During forward movement of the receptacle plates or trays 3, the ampoules slide along the surface 28 moving or urging them in a transverse direction relative to the chain and ejecting them from the trays into aligned openings in the respective holders. The openings secure the ampoules along the body of the ampoule and also at front or neck portions. In a preferred embodiment, camming surface 28 is not continuous but has a configuration containing two or more angular zones 28 and 28' separated by a zone 28'' parallel to the longitudinal axis of the belt. This arrangement makes it possible to vary the force with which the ampoules are inserted into the holders in accordance with the form, dimensions, and number of said ampoules and in accordance with the dimensions and construction of the holder. The configuration of the surface 28 is selected to achieve safe packing of the ampoules and not permit transverse movement of the ampoules in the holder thereby assuring complete immobility of the ampoules in the holder during shipment. Also, during the phase of transverse movement and entry into the holders, the ampoules are to be held in their inserted position in the receptacles 4 by a shoulder 29 which reduces lurching movement keeping them properly aligned with the respective series of openings in the holders.

Once the ampoules are properly inserted, the holders with the ampoules adequately secured continue to advance, being pulled by the trays 3 along rail 21 until they are discharged onto a collection device or onto a conveyor. It will be obvious to equip the machine with a system of guides or rollers which will make it possible to fold the ends of the holders. Also, it is possible to provide a mechanism which will automatically insert the ampoule containing holders into boxes or containers for shipping and marketing.

It has already been mentioned that the top surface of the machine frame and all of the elements described should be somewhat inclined relative to the horizontal. This arrangement offers advantages in assuring, by means of gravity, the correct positioning of the ampoules both in the supply hopper and on the conveyor chain.

Having fully described and disclosed the present invention and the preferred embodiment thereof in such clear and concise terms as to enable those skilled in the art to understand and practice the same, the invention claimed is:

I claimed:

1. A machine for inserting ampoules and similar articles in holders erected from a flat foldable blank, said machine comprising:

a. a conveyor chain adapted to be driven at uniform forward speed by means of an appropriate drive system;

b. ramp means for containing a stack of blanks located adjacent said chain, said ramp means adapted to supply blanks synchronized with the movement of said chain;

c. a series of trays attached to said chain, each of said trays defining a predetermined number of receptacles transversely arranged relative to said chain, said receptacles being regularly spaced and corresponding in number to the number of ampoules that each of said holders is to receive, each of said trays being provided with projection means adapted to engage and remove a single blank form said stack as said tray passes by said ramp means;

d. a supply hopper having an outlet superjacent said chain, said hopper being configured to orient said ampoules in proper alignment whereby said ampoules are discharged by gravity transversely of said chain in said receptacles;

e. means for erecting said blanks into holders; and f. a camming surface located along the path of the chain adapted to engage the ampoules thereby moving said ampoules in a transverse direction relative to the chain and into engagement with the aligned holders.

2. The machine of claim 1, wherein said ramp means is inclined relative to said chain and further including means for applying a predetermined biasing force to the contained stack of blanks.

3. The machine of claim 2, wherein said means for providing a predetermined biasing force comprises roller means cooperable with said ramp, whereby said roller moves along said ramp by gravity applying a predetermined biasing force against the stack of blanks.

4. The machine of claim 3, wherein said hopper outlet has a width in the longitudinal direction of the chain equivalent to the sum of the diameters of a predetermined number of ampoules plus a predetermined clearance, thereby assuring smooth and constant discharge of the receptacles into the trays.

* * * * *